United States Patent [19]

Gullett et al.

[11] Patent Number: 4,651,883

[45] Date of Patent: Mar. 24, 1987

[54] GRAVITY FEED PUSHER MERCHANDISER

[75] Inventors: Edwin P. Gullett, Fayetteville; Leo J. Franz, Lilburn, both of Ga.

[73] Assignee: Leggett & Platt, Incorporated, Carthage, Mo.

[21] Appl. No.: 760,341

[22] Filed: Jul. 29, 1985

[51] Int. Cl.[4] ..... A47F 7/00

[52] U.S. Cl. ..... 211/59.2; 211/59.3; 211/149; 211/195; 221/193; 221/279; 104/140

[58] Field of Search ..... 211/59.2, 59.3, 149, 211/151, 162, 195, 130, 85, 52; 108/32; 221/191, 193, 194, 279; 104/118, 140; 280/11.115

[56] References Cited

U.S. PATENT DOCUMENTS

| | | | |
|---|---|---|---|
| Re. 30,706 | 8/1981 | Bustos . | |
| 201,518 | 3/1878 | Goodrich | 211/162 X |
| 1,779,788 | 10/1930 | Weston | 211/130 |
| 2,443,871 | 6/1948 | Shield . | |
| 2,525,405 | 10/1950 | Feiertag | 211/149 X |
| 2,584,489 | 2/1952 | Morrison | 211/130 X |
| 2,633,249 | 3/1953 | Reed | 211/130 |
| 2,891,677 | 6/1959 | Ritchie | 211/151 X |
| 3,038,613 | 6/1962 | Sylvester et al. | 211/162 |
| 3,203,553 | 8/1965 | Pendergrast et al. . | |
| 3,279,618 | 10/1966 | Bergstedt . | |
| 3,399,784 | 9/1968 | Buchbinder et al. | 211/151 |
| 3,434,706 | 3/1969 | Roder | 104/140 X |
| 4,037,541 | 7/1977 | Giessler et al. | 104/118 X |
| 4,136,783 | 1/1979 | Karashima . | |
| 4,293,062 | 10/1981 | Bustos . | |
| 4,314,648 | 2/1982 | Spamer . | |
| 4,341,313 | 7/1982 | Doring | 211/151 |
| 4,346,806 | 8/1982 | Bustos . | |
| 4,351,439 | 9/1982 | Taylor . | |
| 4,423,818 | 1/1984 | Spamer | 211/59.2 |
| 4,461,388 | 7/1984 | Bustos | 211/59.2 |
| 4,470,943 | 9/1984 | Preis . | |
| 4,482,066 | 11/1984 | Dykstra | 211/151 |

FOREIGN PATENT DOCUMENTS

| | | | |
|---|---|---|---|
| 354558 | 7/1961 | Switzerland | 211/59.3 |

*Primary Examiner*—Ramon S. Britts
*Assistant Examiner*—Blair M. Johnson
*Attorney, Agent, or Firm*—Wood, Herron & Evans

[57] ABSTRACT

A two-tiered display rack merchandiser for gravity feeding two columns of products one after another to the front of the rack as the lead product in either column is successively removed by a customer, each column of which includes a roller-mounted tray which, when loaded with product, is operative to push products located in front of the tray forwardly over a slip surface over which the products would not slide in the absence of the roller-mounted tray pusher at the rear of the column. The rollers of each tray are entrapped within tracks which extend parallel to opposite sides of the slip surfaces such that the trays cannot easily be removed from the rack. The two tiers of the rack are interconnected by a pair of front legs and a pair of rear legs each of which is pivotally mounted to the sides of the rack such that the two tiers can be folded downwardly one atop the other for shipment and then erected by simply pivoting the tiers to an erected position and interconnecting the erected legs with a diagonally extending supporting arm.

8 Claims, 6 Drawing Figures

GRAVITY FEED PUSHER MERCHANDISER

This invention relates to display racks and more particularly to an improved display rack of the gravity-feed type.

Display racks are often used in supermarkets and other types of stores to display items of merchandise generally handled as self-service items. For example, display racks are often used in supermarkets to display cans or bottles of soft drinks, the cans or bottles being removable for purchase by the customer in a self-service manner from the display rack.

A common problem encountered in all self-service display racks is that of constantly moving merchandise forwardly on the shelf of the rack as the forwardmost objects or items of merchandise are removed from the shelf. Traditionally, supermarkets have had store clerks who regularly moved through the store placing new stock on the shelves or moving older stock forwardly on the shelf so as to make it more easily accessible to the customers.

To minimize the need for store clerks to move merchandise forwardly on the store shelves, there have been numerous display racks developed for self-feeding merchandise forwardly on the shelf. In general, most of these display-rack structures incorporate slanted or sloped shelves on which the merchandise is displayed. When the forwardmost object in a given column of objects on a self-feeding shelf is removed, gravity causes the objects behind that front item to move forwardly in the column until stopped at the front edge of the shelf. Typical gravity-feed shelf assemblies of this type are illustrated in Pendergast U.S. Pat. No. 3,203,553 and Shield U.S. Pat. No. 2,443,871. These two patent disclose gravity-feed can racks in which the cans are disposed with their axes horizontal so that the rear cans on the shelf can roll down the sloped shelf in response to removal of the lead can in a column. Another type of gravity-feed shelf assembly is illustrated in Bergstedt U.S. Pat. No. 3,279,618 and Spamer U.S. Pat. No. 4,314,648. In the Bergstedt and the Spamer patents, cans having the axes of the can disposed in a vertical plane slide down a sloped shelf structure to the front edge thereof.

In some instances, either because the coefficient of friction between the bottom of the displayed objects and the top of the self-feeding inclined shelf is too great to permit the objects to be self-feeding over an inclined shelf, or because it is necessary to prevent the objects from sequentially sliding over the sloping surface and crashing into one another, the objects are sometimes mounted upon a self-feeding belt, which belt in turn is moveable over a sloping or flat shelf surface to feed the objects to the front of the shelf when the forwardmost object is removed. Such a belt feed arrangement is disclosed in Bustos U.S. Pat. No. 4,293,062 and Bustos U.S. Pat. No. 4,346,806.

It has also been suggested in those instances wherein the coefficient of friction between the displayed object and the inclined surface is too great to permit the displayed objects to slide over the inclined surface, that the displayed objects be located within roller trays which are in turn rollable over an inclined surface as in U.S. Pat. No. 4,136,783. According to the disclosure of this patent, as the forwardmost displayed object is removed from in front of a roller tray, the tray moves forwardly to locate the tray-supported object at the front of the inclined shelf.

One of the problems characteristic of all of the above-identified gravity-feed racks is an inability or impractibility of those racks or merchandisers to gravity feed over an inclined surface paper-wrapped multipacks of products, such as six-packs or eight-packs of soft drinks. In the case of those gravity-feed merchandisers which feed the product forwardly on an inclined shelf by simply sliding it over a slip surface, the coefficient of friction between the paper board wrappers and the surface is too great to permit this type of merchandiser to be effective. Similarly, the belt-feed merchandisers are also generally impractical for this application because of the relative high cost of the merchandiser and because the weight of the multipack is generally too great for the belts to be effective. The roller-mounted tray of U.S. Patent No. 4,136,783 is effective for feeding these multipack packages over an inclined surface, but following the teaching of this patent, each package, except the forwardmost package, must be contained in a roller-supported tray. If five such packages are to be mounted in a column of packages, following the teaching of this patent, four of those packages are required to be supported in roller-mounted trays. This has been found to be an impractical and excessively expensive solution to the problem of gravity-feeding multipack packages of products over a gravity-feed shelf.

It has therefore been one objective of this invention to provide a gravity-feed merchandiser for gravity-feeding multipack packages of soft drinks or beverages over an inclined surface with a rack which does not require all but the forwardmost package in a column of packages to be supported in roller-supported trays.

To accomplish this objective and in accordance with the invention of this application, a column of multipacks are supported upon a slip surface with the last multipack in the column supported upon a roller tray. When the roller tray is filled with a multipack, it operates as a weighted pusher to push all of the packages in front of the tray forwardly whenever the first package in the column is removed.

Another problem characteristic of all beverage display cases, including gravity-feed cases, is that of effectively merchandising slow-moving products or beverages in the bottom well of a gondola display stand. A gondola display stand is one in which there is a base, a pair of sideposts, and one or more shelves extending from the sideposts in cantilevered fashion over the base. Generally, multipacks of beverages are stacked upon the base in the so-called deep well or bottom well of the gondola rack. The multipacks are generally stacked two or three packages high. A problem occurs, though, when slow-moving multipacks are stacked two or three high in that bottom well. A two or three high stack is often much more of a single product than needs to be displayed at any one time, but the store manager has no choice because he cannot stack one brand upon another without making the bottom brand relatively inaccessible because of a differing brand stacked atop it.

It has therefore been another objective of this invention to provide an improved display rack which may be mounted in the bottom well of a gondola rack and enable that rack to display in an accessible fashion multipacks of differing products stacked one atop the other.

This objective is accomplished according to the practice of this invention by providing a two-tier gravity-feed shelf locatable in the bottom well of a gondola rack and supported upon the base so as to enable accessible columns of differing products to be supported on each tier.

The gravity-feed merchandiser of this invention comprises a two-tiered display rack for gravity feeding two columns of products, one atop another, to the front of the rack if the lead product in a column is removed by a customer. This rack comprises a pair of vertically spaced parallel slip surface members disposed at an angle relative to the horizontal with the slip surface members sloping generally upwardly from the front edge of the rack. Tracks extend along opposite sides of each of the slip surface members and are angled parallel to the slip surface members. A roller-mounted tray is mounted in each pair of tracks and is moveable above each slip surface such that the roller-mounted trays, when loaded with product, are operative to engage the rearwardmost product in a column of products and push the products forwardly over the slip surface when the forwardmost product is removed. The two tiers of the rack are interconnected by a pair of front legs and a pair of rear legs, each of which is pivotally attached to the vertically spaced tiers such that the two tiers can be folded downwardly one atop the other for shipment and then erected by simply pivoting the two tiers to an erected position.

These and other objects and advantages of this invention will be more readily apparent from the following description of the drawings in which.

Figure 1:
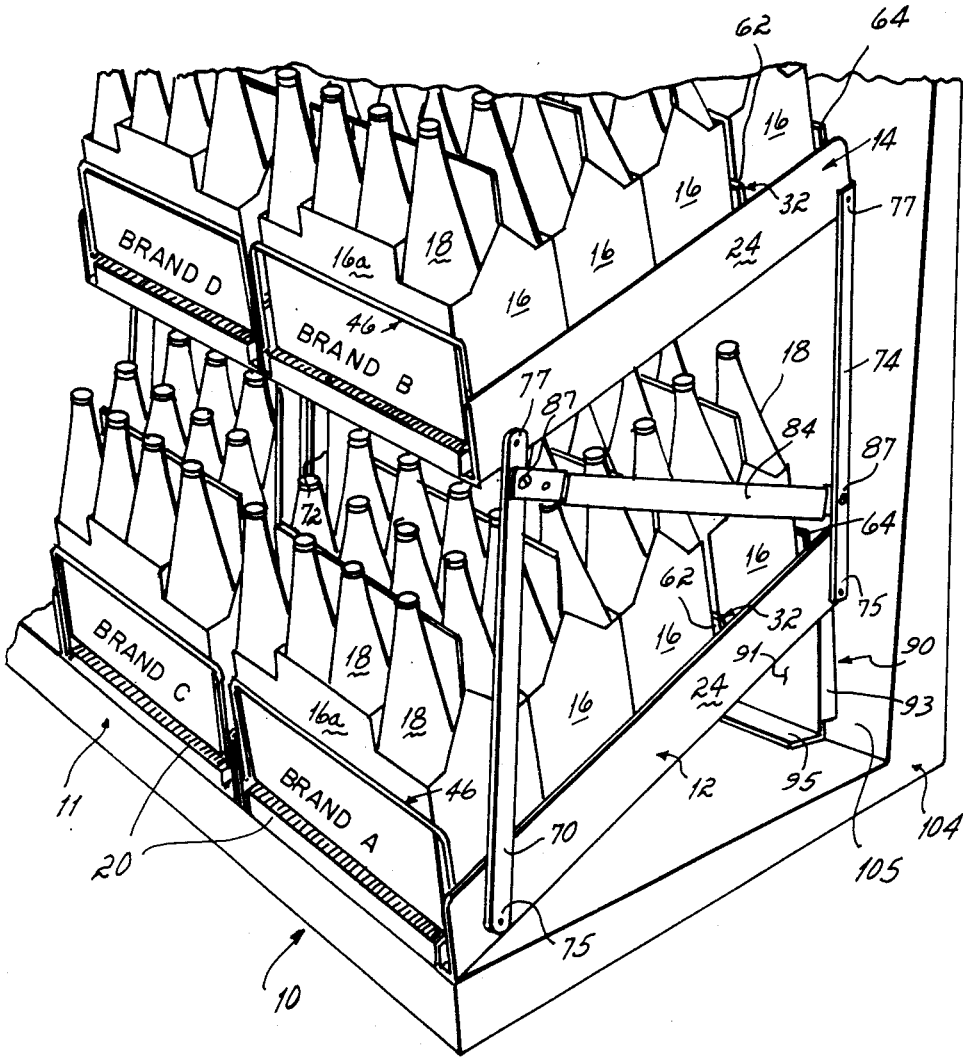
FIG. 1 is a perspective view of two merchandiser display racks incorporating the invention of this application, the racks being mounted in side-by-side relationship and loaded with product.
Figure 2:
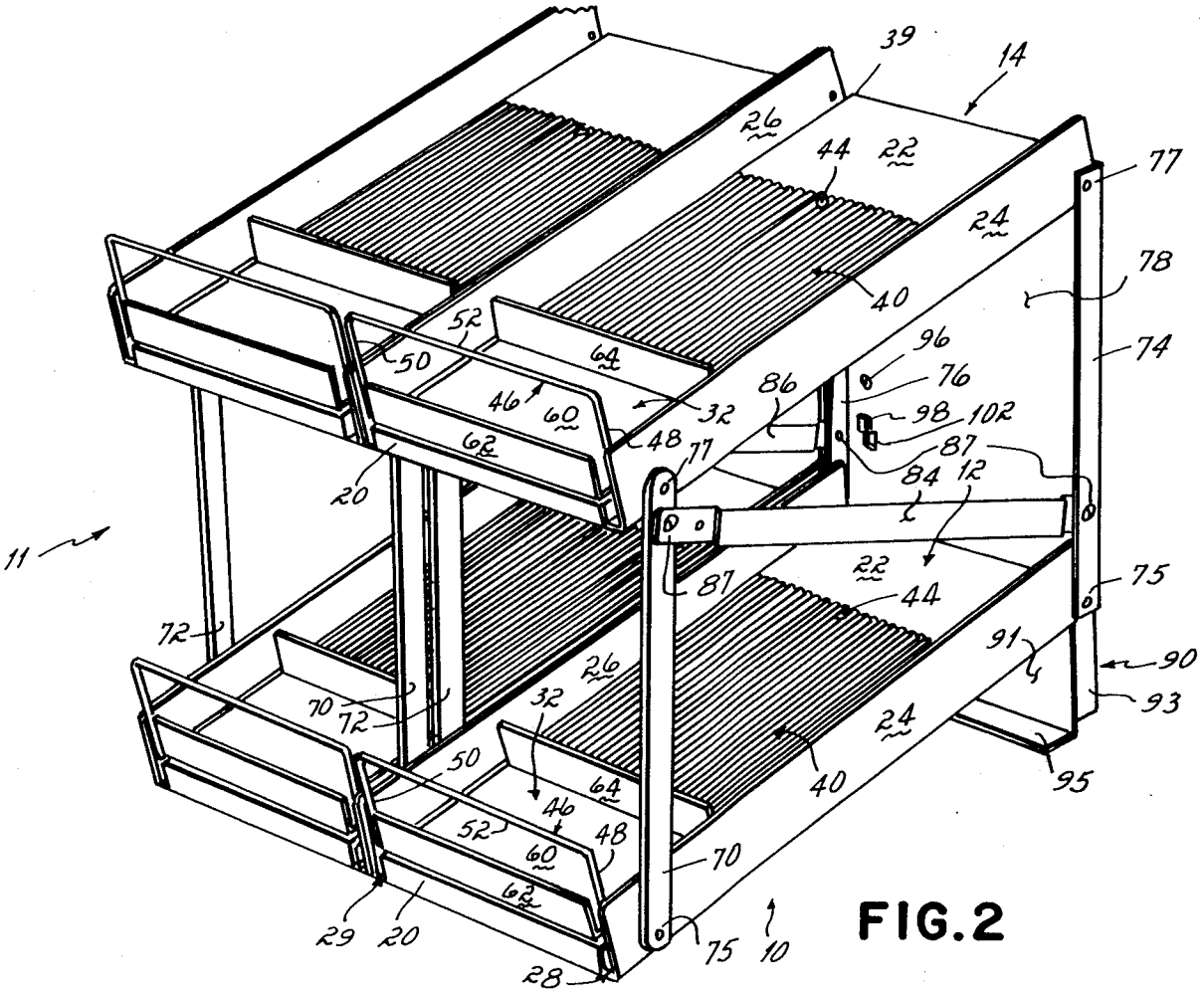
FIG. 2 is a view similar to FIG. 1 but illustrating the racks without product contained therein, the roller trays being displaced to the fronts of the racks.
Figure 3:
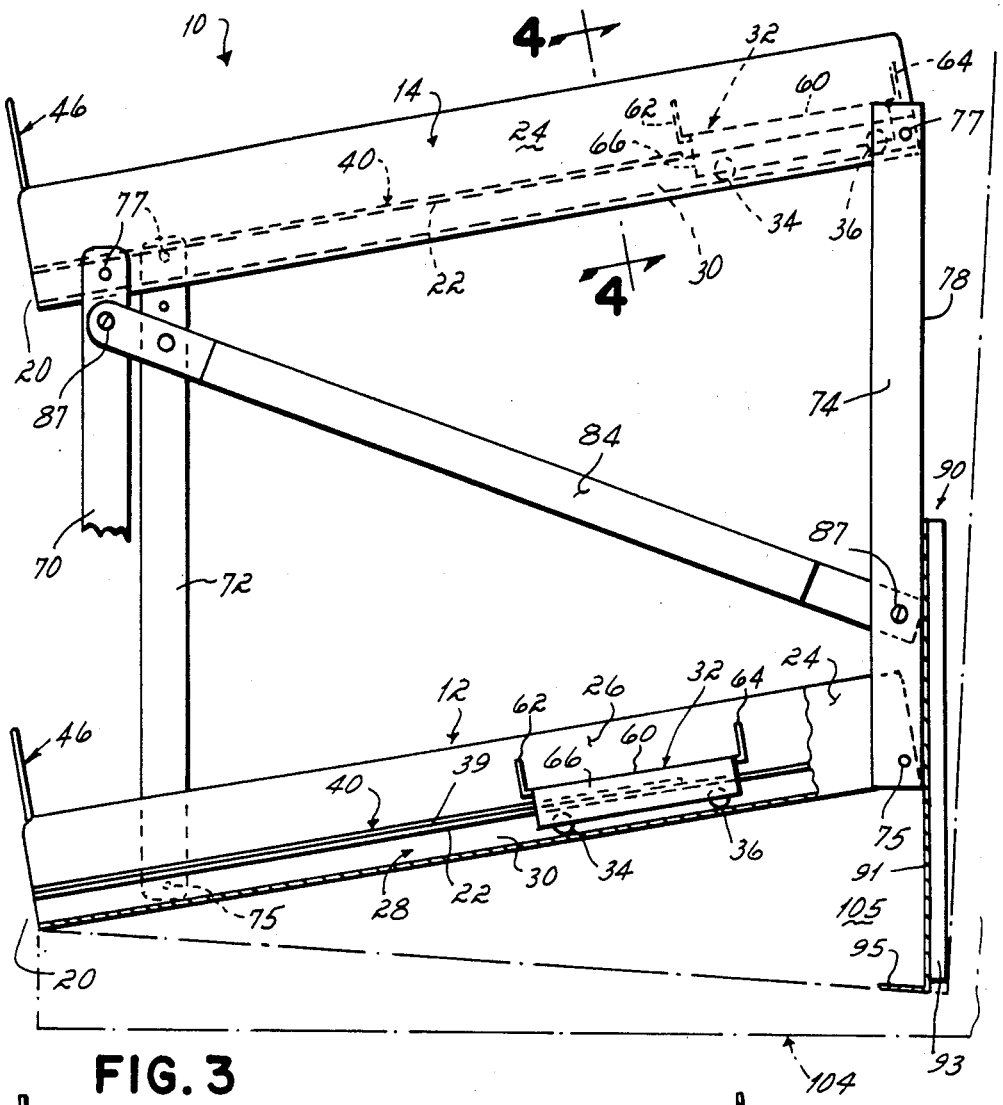
FIG. 3 is a side elevational view, partially broken away, of one rack of FIG. 1.

With reference first to FIGS. 1 and 2, there are illustrated two identical racks 10, 11 positioned in side-by-side relationship and incorporating the invention of this application. Each of these racks is two-tiered and comprises two chutes 12 and 14 positioned one above the other. Each of these chutes 12 and 14 slopes upwardly from front to rear and is adapted to gravity-feed product, such as multipacks 16 of beverage bottles 18, forwardly over the chute as the forwardmost multipack package **16*a* is removed from the front 20** of the chute.

Figure 4:
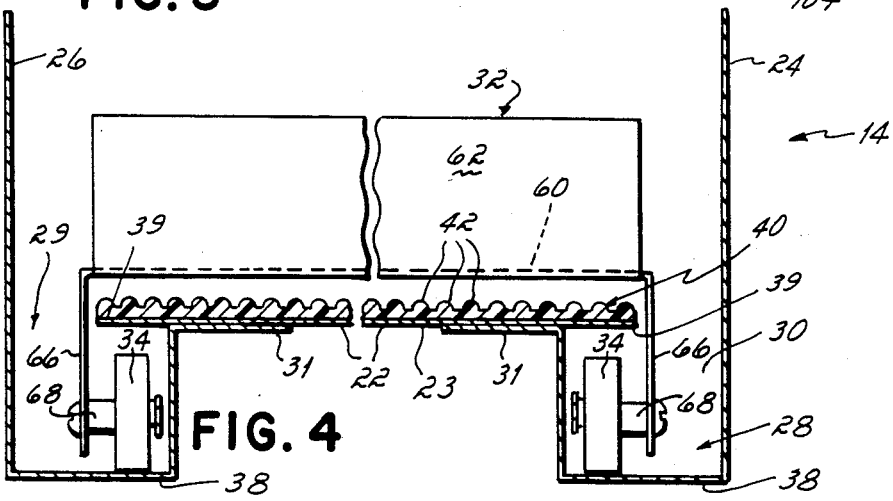
FIG. 4 is a cross-sectional view taken on line 4—4 of FIG. 3.

With reference now particularly to FIGS. 2 and 4, it will be seen that each chute 12, 14 comprises a transverse web panel 22 and a pair of vertical side or flange panels 24, 26 extending upwardly on each side of the transverse web panel. Between the side edge of each transverse web panel 22 and the vertical side panels 24, 26 there are a pair of channels 28, 29 which, as explained more fully hereinafter, function as tracks 30 for a roller tray 32. This roller tray has a pair of rollers 34, 36 mounted on each side of the tray and moveable within one of the tracks 30.

Each chute 12, 14 is manufactured from a flat rectangular sheet of metal 23, to the opposite longitudinal edges of which are welded or otherwise fixedly secured the side channels 28, 29. Each of these channels has a transverse flange 31 welded or otherwise fixedly secured to the underside of the metal sheet 23. A generally L-shaped section 38 of the channels 28, 29 extends between the flange 31 and the vertical side panels 24, 26.

With reference to FIG. 4, it will be seen that the side edge portions 39 of the metal sheets 23 extend into the channels 28, 29 and overhang the top of the rollers 34, 36. This overhang 39 of the metal sheets 34 over the rollers entraps the rollers and thus the trays within the tracks 30 such that the trays 32 cannot be easily removed from the chutes without disassembly of the complete rack.

With continued reference now to FIGS. 2 and 4, it will be seen that there is mounted within each chute 12, 14 a slip surface member 40. This slip surface member 40 in the preferred embodiment comprises a rectangular sheet of extruded plastic having a flat planer base section from which longitudinally extending parallel ribs 42 extend upwardly. This sheet of extruded plastic is conventionally impregnated with silicon so as to increase the slipperiness of the surface and decrease the coefficient of friction between the slip surface member and the multipacks of beverages or other product resting atop the slip surface member. A description of one suitable material from which this slip surface member may be manufactured is to be found in U.S. Pat. No. 4,470,943.

In the preferred embodiment, the slip surface member 40 extends from the front edge 20 of the chutes 12, 14 rearwardly to a point adjacent the rear of the chute. In this illustrated embodiment, wherein each chute is utilized to store four multipacks of beverages, the slip surface member 40 extends from the front edge of the chute approximately three-fourths ($\frac{3}{4}$) of the length of the chute toward the rear. It additionally extends from one side edge to the other side edge of the transverse web panel 22 of the chute so as to cover the front three-fourths ($\frac{3}{4}$) of the transverse web panel. This slip surface could as well completely cover the transverse web panel of the chute, but because the last multipack package stored in the chute is always stored in the roller tray 32, there is no need for the slip surface to extend for the full length of the chute. The slip surface 40 is seured to the top of the transverse web panel 22 by a pair of plastic buttons 44 which have an expansible post (not shown) extending downwardly from the top of the button and passing through a hole in the sheet metal transverse web panel 22.

At the front edge of each chute 12, 14 there is a wire bumper 46 which functions to prevent the forwardmost multipack contained in a column of multipacks from sliding out of the chute. This wire bumper 46 comprises a pair of vertical legs 48, 50 welded or otherwise fixedly secured to the front edge of the side panels 24, 26 and interconnected by a transverse top section 52. When the forwardmost multipack package **16*a* is removed from the front of a column of packages, the following packages slide forward until the front surface of the next package bumps against and is arrested by contact with the wire bumper 46**.

A single tray 32 is mounted within the tracks 30 of each chute 12, 14. Each tray comprises a planer base plate 60 from which a front flange 62 and a rear flange 64 extend upwardly at 90 degrees to the plane of the base plate 60. Additionally, the base plate 60 has a pair of side flanges 66 bent downwardly at 90 degrees from the plane of the base plate 60. Each of these side flanges 60 has a pair of holes extending therethrough within which there are mounted axles 68. Rollers 34, 36 are rotatable upon these axles 68.

The tracks 30 within which the rollers are moveable extend from the front edge 20 to the rear edge of each chute 22. Consequently, each roller-supported tray 32 is freely moveable from the rear to the front of the chute.

Figure 5:
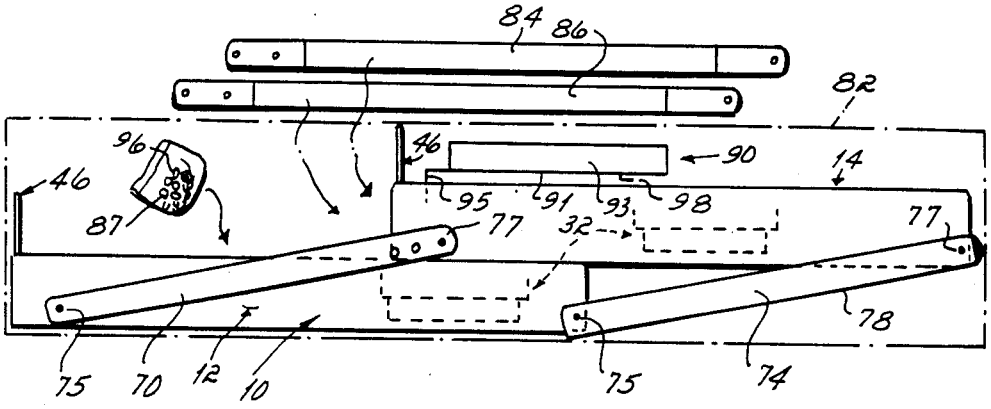
FIG. 5 is a side elevational view of one rack of FIG. 1 disassembled and positioned for shipment or storage.

Each rack 10, 11 is two-tiered. That is, each rack comprises an upper chute 14 mounted directly over a lower chute 12. Each upper chute is supported from a pair of front legs 70, 72 and a pair of rear legs 74, 76. As may be seen most clearly in FIG. 6, the rear legs 74, 76 are formed as forwardly extending flanges of a rear panel 78 of the rack. Each leg 70, 72, 74, 76 is pivotally secured by a rivet 75 at its lower end to a vertical side panel 24, 26 of the lower chute 12 and by a rivet 77 at its upper end to the side panels 24, 26 of the upper chutes. This pivotal connection of the legs 70, 72, 74, 76 to the side panels 24, 26 of the chutes permits the rack to be collapsed, as illustrated in FIG. 5, into a position in which the upper chute rests atop the lower chute. In this collapsed condition of the rack, the rack may be shipped in a relatively small, flat carton illustrated in phantom lines 82 in FIG. 5. Additionally, the rack may be stored in the collapsed condition illustrated in FIG. 5 in order to minimize storage space.

To hold the rack in an erect condition, an arm bracket 84 extends diagonally between the top of one front leg 70 and the bottom of a rear leg 74. Similarly, a second diagonally extending arm bracket 86 extends between the top of the front leg 72 and the bottom of the rear leg 76. These arm brackets are connected to the legs by conventional nut and bolt connectors 87 extending through holes in the legs and arm brackets.

The front legs 70, 72 of each rack are mounted on opposite sides of the rack, but differing distances from the leading edge of the rack. The two legs are parallel one to the other. The purpose of this parallel but offset relationship of the front legs of the rack is to enable multiple racks to be placed side by side on a shelf without the front legs of adjacent racks being stacked one atop the other. As a consequence, the thickness of the front legs, which is substantially greater than that of the rear legs, does not result in substantial spacing between adjacent racks. Instead, the spacing between adjacent racks is reduced because of this staggered relationship of the front legs of each rack.

Figure 6:
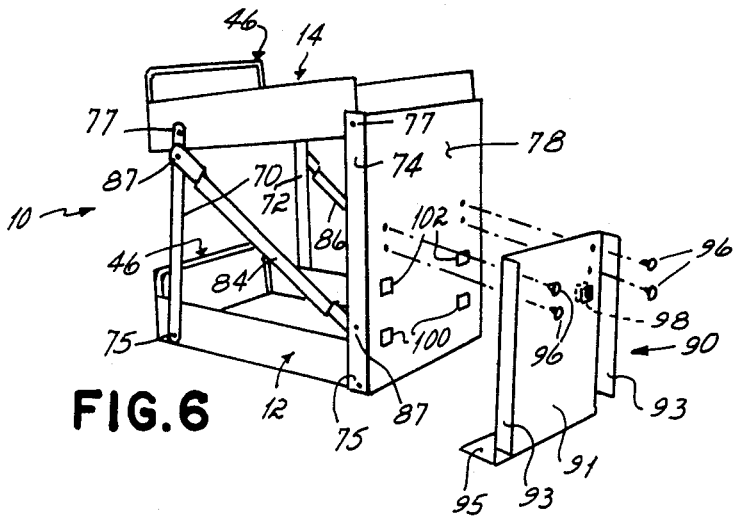
FIG. 6 is an exploded perspective view of the rear of the display rack of FIG. 5.

In order to retain the rear of each rack in a raised attitude relative to the front, such that the chutes of each rack are angled upwardly from front to rear, the rear of each rack is supported by a rear leg panel 90 (see FIG. 6). This rear leg panel 90 is made from sheet metal and comprises a planer front panel 91 from which a pair of side flanges 93 extend rearwardly and a bottom flange 95 extends forwardly. The forwardly extending front flange or foot section of the rear leg panel is intended to be attached to a rack-supporting surface 78 as by screw connectors 96.

The rear leg panel has a pair of forwardly extending tabs 98 stamped from it. Depending upon the desired elevation of the rear of the rack 10, these tabs 98 are adapted to be received either within a pair of lower holes 100 or a pair of upper holes 102 in the rear panel 78 of the rack.

As illustrated in FIGS. 1 and 2, the foot section 95 of the rear leg panel is attached to the top surface of a wedge-shaped supporting base 104. Generally, this base 104 is the base of a conventional gondola rack of the type having a deep bottom well 105 located beneath one or more shelves (not shown) which extend outwardly in cantilever fashion over the supporting base and above product stored in the well 105 of the gondola rack.

In the use of the racks illustrated herein, products such as multipacks of beverages are displayed for sale in the racks. The racks are loaded by placing a first package in a tray at the front of the chute and then pushing that loaded tray rearwardly in the chute and loading additional product in front of the now loaded tray. As a consequence of this loading technique, the last package of product in a column of products stored in the chute always rests within a roller tray 32. The products in front of the roller tray always rests atop the slip surface member 40 and are pushed forwardly by the weighted tray whenever the forwardmost product in a column of products is removed from that rack.

When the product stored in the racks 10, 11 are multipacks of beverage bottles packaged in conventional cardboard containers, the coefficient of friction between the cardboard container and the slip surface of the chute is too high to result in the multipacks sliding forwardly of their own weight. In the absence of some force pushing the multipacks over the slip surface, the packages would sit still upon removal of the first package from the front of the chute. That pushing force is provided by the weighted roller tray. When a multipack of beverage bottles is located within the tray, the tray is sufficiently heavy and rolls sufficiently easily over the tracks 30 as to push all of the beverage packages 16 in front of the roller tray forwardly when the first multipack 16*a* in a column of multipacks is removed. In other words, the force provided by the weighted roller tray is sufficient to cause the multipack of beverage bottles or containers to move forwardly over the slip surface 40 even though, in the absence of the weighted roller tray 32, the multipacks would not move over that slip surface.

One of the advantages of this rack as a merchandiser of multipacks of beverage containers is that it enables differing brands to be stored in each chute of the rack. Generally, when multipacks of beverages are merchandised in the deep bottom well 105 of a gondola-style rack 104, only a single brand may be located in any stack because of the inaccessibility of the lowermost brands. The rack of this invention enables one brand as, for example, Brand A in FIG. 1, to be stored and displayed beneath a different brand, Brand B, located in the upper chute. Similarly, if two racks 10, 11 are utilized in side-by-side relationship, a different Brand C may be stored beneath a Brand D, and all brands are equally accessible. This ease of accessibility of different vertically stacked brands is particularly advantageous in supermarkets or retail locations wherein there are some slow-moving and other much faster moving brands. The supermarket or retail store is often required to sell the slow-moving brands in order to satisfy all customers and would, therefore, like to store them in a vertically stacked orientation so as to minimize floor space for those slow-moving brands. The display rack of this invention facilitates that vertically stacked orientation and display of differing brands.

While we have described only a single preferred embodiment of our invention, persons skilled in this art will appreciate changes and modifications which may be made without departing from the spirit of our invention. Therefore, we do not intend to be limited except by the scope of the following appended claims.

Having described our invention, we claim:

1. A multiple-tier display rack for gravity feeding two columns of products one after another to the front of the rack as the lead product in either column is successively removed by a customer, said display rack comprising at least a pair of vertically spaced, parallel slip surface members disposed at an angle relative to the horizontal, said slip surface members each sloping generally upwardly from a front edge of said rack, a supporting surface member beneath each of said slip surface members, said supporting surface members and said slip surface members cooperating to support product in said columns on the upper surface of said slip surface members, trackways extending along opposite sides of each of said slip surface members, said trackways being angled relative to the horizontal at the same angle as said slip surface members so that said trackways extend parallel to said slip surface members, at least a pair of roller-mounted trays, each of said trays having rollers moveable within said trackways, each of said trays being supported upon said rollers for movement above but spaced from one of said slip surface members, said roller-mounted trays when loaded with product being operative to engage the rearwardmost product in one of said columns of products supported upon one of said slip surface members and upon removal of said forwardmost product from the columns, to push the remaining products in said column forwardly over the said one of said slip surface members, each of said supporting surface members comprising an elongated sheet metal chute having a transverse web panel and a pair of vertical side panels extending upwardly from each side of said web panel, each of said chutes being mounted one above the other upon a pair of front legs and upon a pair of rear legs, each of said pair of front legs being located on opposite sides of said chutes and attached to the vertical side panels of said chutes, and each of said pair of rear legs being located on opposites of said chutes and attached to the vertical side panels of said chutes, said pair of rear legs being formed by side flanges of a sheet metal rear panel of said rack, and the rear of said rack being retained in a raised position relative to said front of said rack by a sheet metal rear leg panel, said sheet metal rear leg panel having a horizontal foot section adapted to rest upon a supporting surface and a vertical section adapted to be secured to said rear panel of said rack.

2. The display rack of claim 1 wherein said vertical section of said rear leg panel is secured to said rear panel of said rack by upwardly extending tabs bent from said rear leg panel and extending through holes in said rear panel of said rack.

3. A multiple-tier display rack for gravity feeding two columns of products one after another to the front of the rack as the lead product in either column is successively removed by a customer, said display rack comprising at least a pair of vertically spaced, parallel slip surface members disposed at an angle relative to the horizontal, said slip surface members each sloping generally upwardly from a front edge of said rack, a supporting surface member beneath each of said slip surface members, said supporting surface members and said slip surface members cooperating to support product in said column on the upper surface of said slip surface members, trackways extending along opposite sides of each of said slip surface members, said trackways being angled relative to the horizontal at the same angle as said slip surface members so that said trackways extend parallel to said slip surface members, at least a pair of roller mounted trays, each of said trays having rollers moveable within said trackways, each of said trays being supported upon said rollers for movement above but spaced from one of said slip surface members, said roller-mounted trays when loaded with product being operative to engage the rearwardmost product in one of said columns of products supported upon one of said slip surface members and upon removal of said forwardmost product from the columns to push the remaining products in said column forwardly over the said one of said slip surface members, each of said supporting surface members comprising an elongated chute having a transverse web panel and a pair of vertical side panels extending upwardly from each side of said web panel, each of said chutes having a channel-shaped trackway formed on each side of said transverse web panel, each of said channel-shaped trackways having an inner vertical side wall an an outer side wall, said rollers of said roller-mounted tray being received within said channel-shaped trackway between said inner and outer side walls, and each of said slip surface members extending laterally outwardly beyond said inner vertical walls of said channel-shaped trackways and over said rollers so as to entrap said rollers such that said roller-mounted trays cannot be lifted from said chutes.

4. The display rack of claim 3 wherein each of said slip surface members comprises a sheet of silicone impregnated plastic.

5. The display rack of claim 3 wherein each of said chutes are mounted one above the other upon a pair of front legs and upon a pair of rear legs, each of said pair of front legs being located on opposite sides of said chutes and attached to the vertical side panels of said chutes, and each of said pair of rear legs being located on opposite sides of said chutes and attached to the vertical side panels of said chutes.

6. The display rack of claim 5 wherein each of said front and rear legs is pivotally attached to said side panels of said chutes such that said rack may be collapsed into a flat package for shipment.

7. The display rack of claim 6 wherein said rack is retained in an erect attitude with one chute above the other by at least one arm bracket extending diagonally between and secured to one of said front legs and one of said rear legs.

8. The display rack of claim 6 wherein said rack is retained in an erect attitude with one chute above the other by a pair of arm brackets, each of said arm brackets extending diagonally between and being secured to one of said pair of front legs and one of said pair of rear legs.

* * * * *